US006241365B1

(12) United States Patent
Cook et al.

(10) Patent No.: US 6,241,365 B1
(45) Date of Patent: Jun. 5, 2001

(54) LIGHT SUPPORT AND CLOTHES HANGER DEVICE

(76) Inventors: Mark C. Cook; Stephen C. Cook, both of 4938 Pine Ave., Newago, MI (US) 49337

( * ) Notice: Subject to any disclaimer, the term of this patent is extended or adjusted under 35 U.S.C. 154(b) by 0 days.

(21) Appl. No.: 09/512,446

(22) Filed: Feb. 25, 2000

(51) Int. Cl.[7] ..... F21V 33/00

(52) U.S. Cl. ..... 362/253; 362/217; 362/260; 362/378

(58) Field of Search ..... 362/253, 103, 362/147, 217, 260, 376, 378, 801

(56) References Cited

U.S. PATENT DOCUMENTS

| | | | |
|---|---|---|---|
| D. 315,862 | 4/1991 | Specker, Jr. . | |
| 2,922,029 | 1/1960 | Eschelbach et al. . | |
| 4,246,629 | 1/1981 | Marrero . | |
| 4,367,517 | 1/1983 | Balzer . | |
| 5,099,402 | 3/1992 | Starniri . | |
| 5,331,526 | 7/1994 | Girot et al. . | |
| 5,836,675 * | 11/1998 | Woodring | 362/253 X |

* cited by examiner

*Primary Examiner*—Stephen Husar

(57) ABSTRACT

A light support and clothes hanger device for combining a light with a clothes hanger bar. The light support and clothes hanger device includes an elongate housing having a top wall and end walls for securely mounting to a ceiling in a building structure; and also includes a light-emitting member securely and removably mounted in the housing; and further includes a plurality of hanger support mounting members securely fastened to the top wall of the elongate housing; and also includes a hanger support member securely mounted to the hanger support mounting members and to the end walls of the elongate housing; and further includes an on/off switch mounted to the elongate housing for energizing the light-emitting member, at least one ballast connected to the on/off switch, and a power cord connected to the on/off switch.

7 Claims, 2 Drawing Sheets

LIGHT SUPPORT AND CLOTHES HANGER DEVICE

BACKGROUND OF THE INVENTION

1. Field of the Invention

The present invention relates to a light hanger device and more particularly pertains to a new light support and clothes hanger device for combining a light with a clothes hanger bar.

2. Description of the Prior Art

The use of a light hanger device is known in the prior art. More specifically, light hanger device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,331,526; U.S. Pat. No. 4,367,517; U.S. Pat. No. 2,922,029; U.S. Pat. No. 5,099,402; U.S. Pat. No. 4,246,629; and U.S. Pat. No. Des. 315,862.

While these devices fulfill their respective, particular objectives and requirements, the aforementioned patents do not disclose a new light support and clothes hanger device. The inventive device includes an elongate housing having a top wall and end walls for securely mounting to a ceiling in a building structure; and also includes a light-emitting member securely and removably mounted in the housing; and further includes a plurality of hanger support mounting members securely fastened to the top wall of the elongate housing; and also includes a hanger support member securely mounted to the hanger support mounting members and to the end walls of the elongate housing; and further includes an on/off switch mounted to the elongate housing for energizing the light-emitting member, at least one ballast connected to the on/off switch, and a power cord connected to the on/off switch.

In these respects, the light support and clothes hanger device according to the present invention substantially departs from the conventional concepts and designs of the prior art, and in so doing provides an apparatus primarily developed for the purpose of combining a light with a clothes hanger bar.

SUMMARY OF THE INVENTION

In view of the foregoing disadvantages inherent in the known types of light hanger device now present in the prior art, the present invention provides a new light support and clothes hanger device construction wherein the same can be utilized for combining a light with a clothes hanger bar.

The general purpose of the present invention, which will be described subsequently in greater detail, is to provide a new light support and clothes hanger device which has many of the advantages of the light hanger device mentioned heretofore and many novel features that result in a new light support and clothes hanger device which is not anticipated, rendered obvious, suggested, or even implied by any of the prior art light hanger device, either alone or in any combination thereof.

To attain this, the present invention generally comprises an elongate housing having a top wall and end walls for securely mounting to a ceiling in a building structure; and also includes a light-emitting member securely and removably mounted in the housing; and further includes a plurality of hanger support mounting members securely fastened to the top wall of the elongate housing; and also includes a hanger support member securely mounted to the hanger support mounting members and to the end walls of the elongate housing; and further includes an on/off switch mounted to the elongate housing for energizing the light-emitting member, at least one ballast connected to the on/off switch, and a power cord connected to the on/off switch.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new light support and clothes hanger device which has many of the advantages of the light hanger device mentioned heretofore and many novel features that result in a new light support and clothes hanger device which is not anticipated, rendered obvious, suggested, or even implied by any of the prior art light hanger device, either alone or in any combination thereof.

It is another object of the present invention to provide a new light support and clothes hanger device which may be easily and efficiently manufactured and marketed.

It is a further object of the present invention to provide a new light support and clothes hanger device which is of a durable and reliable construction.

An even further object of the present invention is to provide a new light support and clothes hanger device which is susceptible of a low cost of manufacture with regard to both materials and labor, and which accordingly is then susceptible of low prices of sale to the consuming public, thereby making such light support and clothes hanger device economically available to the buying public.

Still yet another object of the present invention is to provide a new light support and clothes hanger device which provides in the apparatuses and methods of the prior art some of the advantages thereof, while simultaneously overcoming some of the disadvantages normally associated therewith.

Still another object of the present invention is to provide a new light support and clothes hanger device for combining a light with a clothes hanger bar.

Yet another object of the present invention is to provide a new light support and clothes hanger device which includes an elongate housing having a top wall and end walls for securely mounting to a ceiling in a building structure; and also includes a light-emitting member securely and removably mounted in the housing; and further includes a plurality of hanger support mounting members securely fastened to the top wall of the elongate housing; and also includes a hanger support member securely mounted to the hanger support mounting members and to the end walls of the elongate housing; and further includes an on/off switch mounted to the elongate housing for energizing the light-emitting member, at least one ballast connected to the on/off switch, and a power cord connected to the on/off switch.

Still yet another object of the present invention is to provide a new light support and clothes hanger device that essentially saves the user a lot of space since the light support can also be used for hanging clothes.

Even still another object of the present invention is to provide a new light support and clothes hanger device that is easy and convenient to install and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
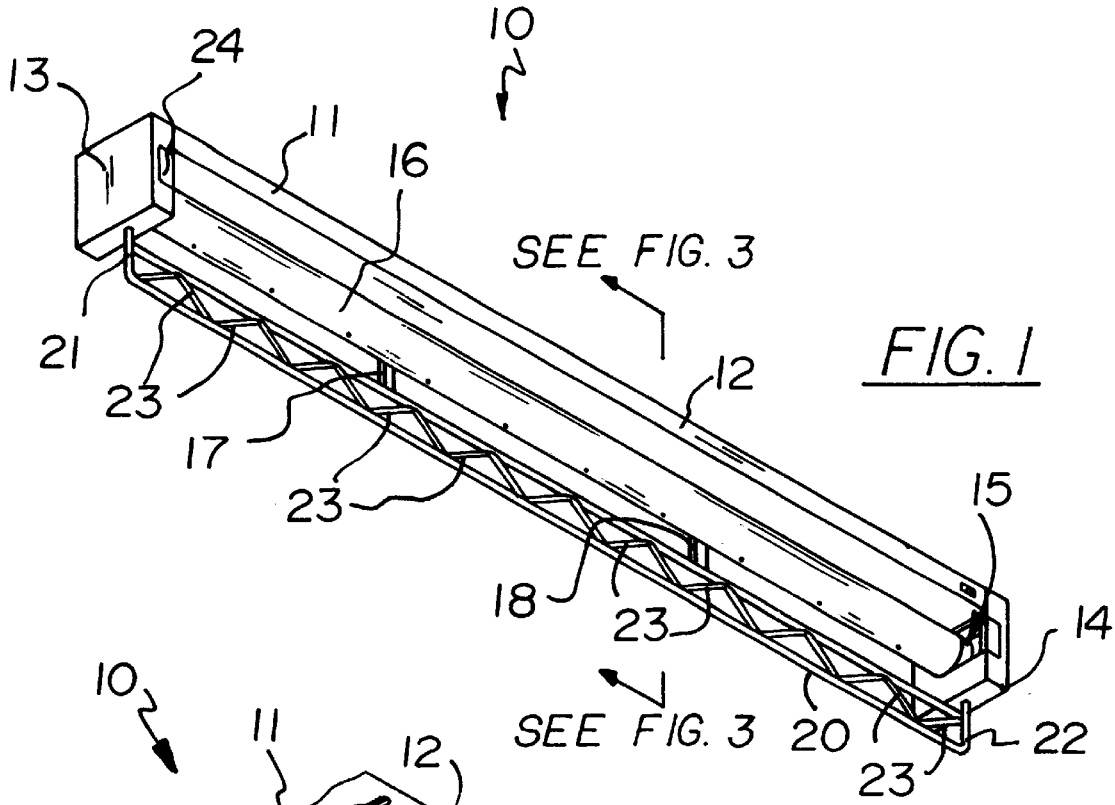
FIG. 1 is a perspective view of a new light support and clothes hanger device according to the present invention.
Figure 2:
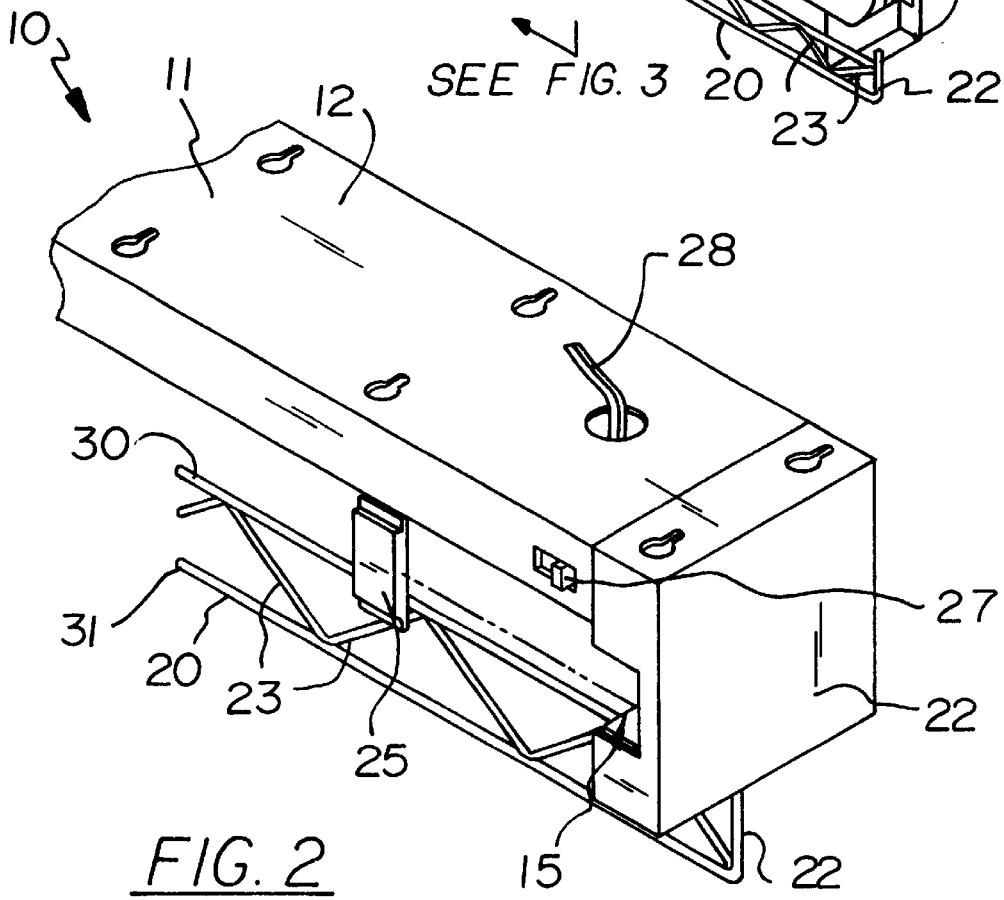
FIG. 2 is a detailed perspective view of the present invention.
Figure 3:
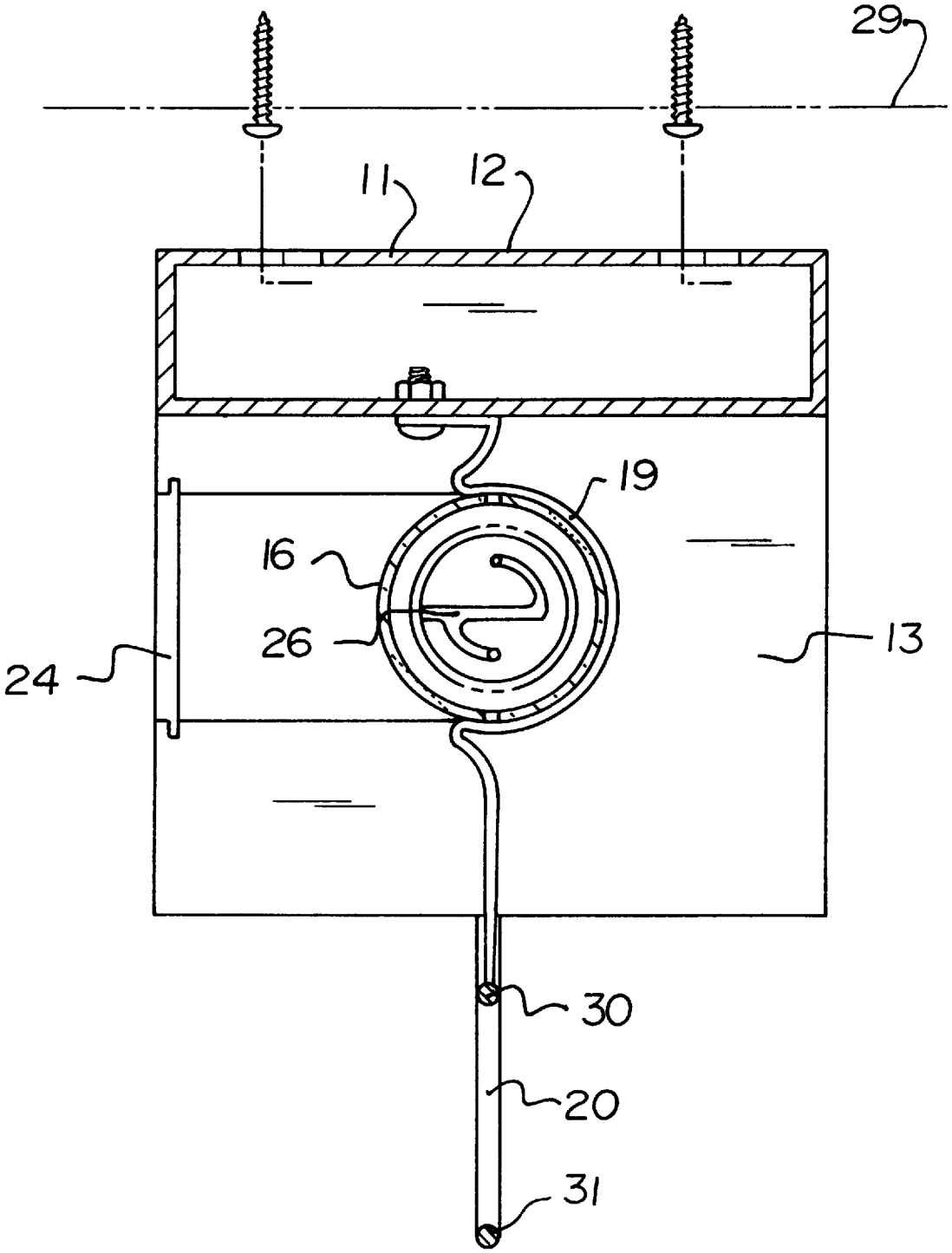
FIG. 3 is a cross-sectional view of the present invention.

With reference now to the drawings, and in particular to FIGS. 1 through 3 thereof, a new light support and clothes hanger device embodying the principles and concepts of the present invention and generally designated by the reference numeral 10 will be described.

As best illustrated in FIGS. 1 through 3, the light support and clothes hanger device 10 generally comprises an elongate housing 11 having a top wall 12 and end walls 13,14. Each of the end walls 13,14 has a light bulb receiving slot 15 extending through a front end and an interior side thereof. A light-emitting member 16 having ends is removably and conventionally disposed in the elongate housing 11. Each of the ends of the light-emitting member 16 is removably received in a respective light bulb receiving slot 15. Hanger support mounting members 17,18 are securely mounted and bolted to and suspended from the elongate housing 11. The hanger support mounting members 17,18 are securely mounted to the top wall 12 of the elongate housing 11. Each of the hanger support mounting members 17,18 has an arcuate upper portion 19 which extends about the light-emitting member 16 removably disposed in the elongate housing 12. An elongate hanger support member 20 is securely mounted and welded to the hanger support mounting members 17,18 and to the elongate housing 11 and is suspended therefrom. The hanger support member 20 includes a pair of elongate members 30,31 horizontally disposed below the elongate housing 11 and extending a length of the elongate housing 11, and also includes a pair of end members 21,22 conventionally interconnecting ends of the elongate members 30,31 and being securely and conventionally mounted to the undersides of the end walls 13,14 of the elongate housing 11, and further includes a plurality of cross members 23 conventionally interconnecting and supporting the elongate members 30,31 along the lengths thereof. Slot-blocking members 24,25 are removably and securely disposed in the light bulb receiving slots 15 to essentially prevent the light-emitting member 16 from coming out of the elongate housing 11. Each of the slot-blocking members 24,25 includes a plate-like member having a back side, a front side with the front side having recessed end portions for securely attaching the slot-blocking member 24,25 in a respective light bulb receiving slot 15 with the front side of the plate-like member being essentially flush with the front end of the respective end wall 13,14 of the elongate housing 11. Means for energizing the light-emitting member 16 includes an on/off switch 27 securely and conventionally mounted to the elongate housing 11, at least one ballast 26 securely and conventionally mounted in the end walls 13,14 of the elongate housing 11 and being connected to the on/off switch 27, and a power cord 28 connected to the on/off switch 27 and extending through a hole in the top wall 12 of the elongate housing 11 which is adapted to securely fasten to a ceiling 29 of a building structure.

In use, the light support and clothes hanger device 10 can be securely fastened to a ceiling 29 in a building structure especially in a closet. The user can then use hangers to suspend clothes from the hanger support member 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A light support and clothes hanger device comprising:

an elongate housing having a top wall and end walls, each of said end walls having a light bulb receiving slot extending through a front end and an interior side thereof;

a light-emitting member having ends and being removably disposed in said housing, each of said ends of said light-emitting member being removably received in a respective said light bulb receiving slot;

hanger support mounting members securely mounted to and suspended from said elongate housing;

an elongate hanger support member being securely mounted to said hanger support mounting members and to said elongate housing and being suspended therefrom;

slot-blocking members removably and securely disposed in said light bulb receiving slots to essentially prevent said light-emitting member from coming out of said housing; and means for energizing said light-emitting member.

2. A light support and clothes hanger device as described in claim 1, wherein said hanger support mounting members are securely mounted to said top wall of said housing.

3. A light support and clothes hanger device as described in claim 2, wherein each of said hanger support mounting members has an arcuate upper portion which extends about said light-emitting member disposed in said elongate housing.

4. A light support and clothes hanger device as described in claim 3, wherein said hanger support member includes a pair of elongate members horizontally disposed below said elongate housing and extending a length of said elongate housing; and also includes a pair of end members interconnecting ends of said elongate members and being securely mounted to said end walls of said elongate housing; and further includes a plurality of cross members interconnecting and supporting said elongate members along lengths thereof.

5. A light support and clothes hanger device as described in claim 4, wherein each of said slot-blocking members includes a plate-like member having a back side, a front side with said front side having recessed end portions for securely attaching said slot-blocking member in a respective said light bulb receiving slot, said front side of said plate-like member being essentially flush with said front end of said respective end wall of said elongate housing.

6. A light support and clothes hanger device as described in claim 5, wherein said means for energizing said light-emitting member includes an on/off switch securely mounted to said elongate housing, at least one ballast securely mounted to said elongate housing and being connected to said on/off switch, and a power cord connected to said on/off switch and extending through a hole in said top wall of said elongate housing.

7. A light support and clothes hanger device comprising:

an elongate housing having a top wall and end walls, each of said end walls having a light bulb receiving slot extending through a front end and an interior side thereof;

a light-emitting member having ends and being removably disposed in said housing, each of said ends of said light-emitting member being removably received in a respective said light bulb receiving slot;

hanger support mounting members securely mounted to and suspended from said elongate housing, said hanger support mounting members being securely mounted to said top wall of said housing, each of said hanger support mounting members having an arcuate upper portion which extends about said light-emitting member disposed in said elongate housing;

an elongate hanger support member being securely mounted to said hanger support mounting members and to said elongate housing and being suspended therefrom, said hanger support member including a pair of elongate members horizontally disposed below said elongate housing and extending a length of said elongate housing; and also including a pair of end members interconnecting ends of said elongate members and being securely mounted to said end walls of said elongate housing; and further including a plurality of cross members interconnecting and supporting said elongate members along lengths thereof;

slot-blocking members removably and securely disposed in said light bulb receiving slots to essentially prevent said light-emitting member from coming out of said housing, each of said slot-blocking members including a plate-like member having a back side, a front side with said front side having recessed end portions for securely attaching said slot-blocking member in a respective said light bulb receiving slot, said front side of said plate-like member being essentially flush with said front end of said respective end wall of said elongate housing; and means for energizing said light-emitting member including an on/off switch securely mounted to said elongate housing, at least one ballast securely mounted to said elongate housing and being connected to said on/off switch, and a power cord connected to said on/off switch and extending through a hole in said top wall of said elongate housing.

* * * * *